US009434179B2

(12) United States Patent
Bitoh

(10) Patent No.: US 9,434,179 B2
(45) Date of Patent: Sep. 6, 2016

(54) NAIL PRINT APPARATUS

(75) Inventor: Hiroyasu Bitoh, Ome (JP)

(73) Assignee: CASIO COMPUTER CO., LTD., Tokyo (JP)

( * ) Notice: Subject to any disclaimer, the term of this patent is extended or adjusted under 35 U.S.C. 154(b) by 974 days.

(21) Appl. No.: 13/549,670

(22) Filed: Jul. 16, 2012

(65) Prior Publication Data

US 2013/0019799 A1 Jan. 24, 2013

(30) Foreign Application Priority Data

Jul. 19, 2011 (JP) ..... 2011-157600
Sep. 15, 2011 (JP) ..... 2011-201319

(51) Int. Cl.
*B41J 3/407* (2006.01)

(52) U.S. Cl.
CPC ..... *B41J 3/407* (2013.01)

(58) Field of Classification Search
CPC ..... A45D 2029/005; A45D 29/22; A45D 29/00; B41F 17/14; B41F 17/18; B41F 17/36; B41J 3/4073; B41J 3/407
USPC ..... 132/73, 73.5, 73.6, 74.5, 285; 101/35, 101/41; 347/2, 4
See application file for complete search history.

(56) References Cited

U.S. PATENT DOCUMENTS 5,931,166 A * 8/1999 Weber et al. ..... 132/73
6,035,860 A * 3/2000 Mombourquette ..... 132/200
6,067,996 A 5/2000 Weber et al.
6,206,506 B1 * 3/2001 Takemura et al. ..... 347/49
6,336,694 B1 1/2002 Ishizaka
6,347,635 B1 * 2/2002 Jenkins et al. ..... 132/73
7,451,894 B2 * 11/2008 Ophardt ..... A47K 5/12 222/181.3
8,496,013 B2 * 7/2013 McCourtney ..... A45D 29/023 132/73.5
2013/0021395 A1 1/2013 Bitoh

FOREIGN PATENT DOCUMENTS

JP 2000-194838 A 7/2000
JP 2010247091 * 5/2010

OTHER PUBLICATIONS

U.S. Appl. No. 13/549,688; First Named Inventor: Hiroyasu Bitoh; Title: "Nail Print Apparatus"; filed Jul. 16, 2012.

* cited by examiner

*Primary Examiner* — Todd E Manahan
*Assistant Examiner* — Brianne Kalach
(74) *Attorney, Agent, or Firm* — Holtz, Holtz & Volek PC

(57) ABSTRACT

A nail print apparatus which prints on a nail. The nail print apparatus includes a partition wall and a printing section. A first surface of the partition wall is in contact with at least one first finger inserted on the first surface. A second surface of the partition wall is in contact with at least one second finger, which is different from the first finger, inserted on the second surface. The first surface and the second surface are held between the first finger and the second finger from a first end of the partition wall. A thickness of the partition wall between the first surface and the second surface increases from the first end toward a second end opposite to the first end.

11 Claims, 11 Drawing Sheets

NAIL PRINT APPARATUS

CROSS-REFERENCE TO RELATED APPLICATIONS

This application is based upon and claims the benefit of priority from the prior Japanese Patent Application No. 2011-157600, filed Jul. 19, 2011, and Japanese Patent Application No. 2011-201319, filed Sep. 15, 2011, the entire contents of all of which are incorporated herein by reference.

BACKGROUND OF THE INVENTION

1. Field of the Invention

The present invention relates to a nail print apparatus. Specifically, the present invention relates to a nail print apparatus which applies ink to fingernails.

2. Description of the Related Art

The nail print apparatus is a print apparatus which includes a print device and the nail print apparatus prints a desired image on fingernails with the print device.

A nail print apparatus with an insertion opening formed on a front face of the apparatus and a placement stage provided in the far side of the opening is described in for example, Japanese Patent Application Laid-Open Publication No. 2000-194838.

With the nail print apparatus, the user inserts a finger with a nail of a print target in the insertion opening, and places the finger on the placement stage. The fingernail placed on the placement stage is to be the print target and a desired image in which color, picture, design, etc. are set is printed on the fingernail with the print device.

However, in the above nail print apparatus, the fingers other than the finger with the nail of the print target placed on the placement stage while printing are placed bent in the front face of the case main body of the nail print apparatus. Therefore, the other fingers are in a tight state while printing and it is difficult to stably hold the finger with the nail of the print target on the placement stage. When the other fingers are pressed to the front face of the case main body of the nail print apparatus to hold the finger with the nail of the print target in the predetermined position of the placement stage while printing, the other fingers are tightened which provides stress and discomfort to the user.

SUMMARY OF THE INVENTION

The present invention has an advantage of providing a nail print apparatus in which a first finger can be easily held stably in a predetermined position while printing by holding the first finger including the nail of the print target and by keeping a state in which the other second fingers are not in a tight state and stress is not applied to the second finger while the printing is performed on the nail of the first finger.

In order to obtain the above advantages, according to an aspect of the present invention, there is provided a nail print apparatus which prints on a nail including:

a partition wall which includes a first surface, a second surface opposite to the first surface, a first end and a second end opposite to the first end, wherein the first surface is in contact with at least one first finger inserted on the first surface in a direction from a side of the first end of the partition wall toward a side of the second end of the partition wall;

the second surface is in contact with at least one second finger, which is different from the first finger, inserted on the second surface in a direction from a side of the first end of the partition wall toward a side of the second end of the partition wall; and the first surface and the second surface are held between the first finger and the second finger from a side of the first end; and a printing section which includes a printing head that applies ink to a nail of the first finger, wherein a thickness of the partition wall between the first surface and the second surface increases from the first end toward the second end.

In order to obtain the above advantages, according to another aspect of the present invention, there is provided a nail print apparatus which prints on a nail including:

a partition wall which includes a first surface, a second surface opposite to the first surface, a first end and a second end opposite to the first end, wherein the first surface is in contact with at least one first finger inserted on the first surface in a direction from a side of the first end of the partition wall toward a side of the second end of the partition wall;

the second surface is in contact with at least one second finger, which is different from the first finger, inserted on the second surface in a direction from a side of the first end of the partition wall toward a side of the second end of the partition wall; and the first surface and the second surface are held between the first finger and the second finger from a side of the first end; and a printing section which includes a printing head that applies ink to a nail of the first finger, wherein the partition wall includes a projecting section and a depressed section on the second surface;

the projecting section is provided on a portion of the second surface from a side of the first end;

the depressed section is provided on the second end of the projecting section so as to be in contact with the projecting section;

the second surface includes a shape at the projecting section where a thickness between the first surface and the second surface increases from the first end toward the second end; and the second surface includes a shape depressed to the first surface in a region of the depressed section in contact with the projecting section and the thickness is smaller than a maximum value of the thickness at the projecting section.

Additional advantages of the invention will be set forth in the description which follows, and in part will be obvious from the description, or may be learned by practice of the invention. The advantages of the invention may be realized and obtained by means of the instrumentalities and combinations particularly pointed out hereinafter.

BRIEF DESCRIPTION OF THE SEVERAL VIEWS OF THE DRAWINGS

The accompanying drawings, which are incorporated in and constitute a part of the specification, illustrate embodiments of the invention, and together with the general description given above and the detailed description of the embodiments given below, serve to explain the principles of the invention;

FIG. 5A shows a first form of a shape of an inner surface of the first finger receiving section and FIG. 5B shows a second form of a shape of an inner surface of the first finger receiving section;

FIG. 6A shows a state where a finger other than the thumb is inserted in the first finger receiving section and FIG. 6B shows a state where the thumb is inserted in the first finger receiving section;

FIG. 7A is a diagram showing a first form of the modification of the first finger receiving section and FIG. 7B is a diagram showing a second form of the modification of the first finger receiving section;

DETAILED DESCRIPTION OF THE INVENTION

The nail print apparatus of the present invention is described in detail by showing preferred embodiments.

The embodiments described below include various technically preferable limitations to employ the present invention. However, the scope of the invention is not limited to the embodiments and the illustrated examples.

<First Embodiment>

A first embodiment of the nail print apparatus of the present invention is described with reference to the drawings.

Figure 1:
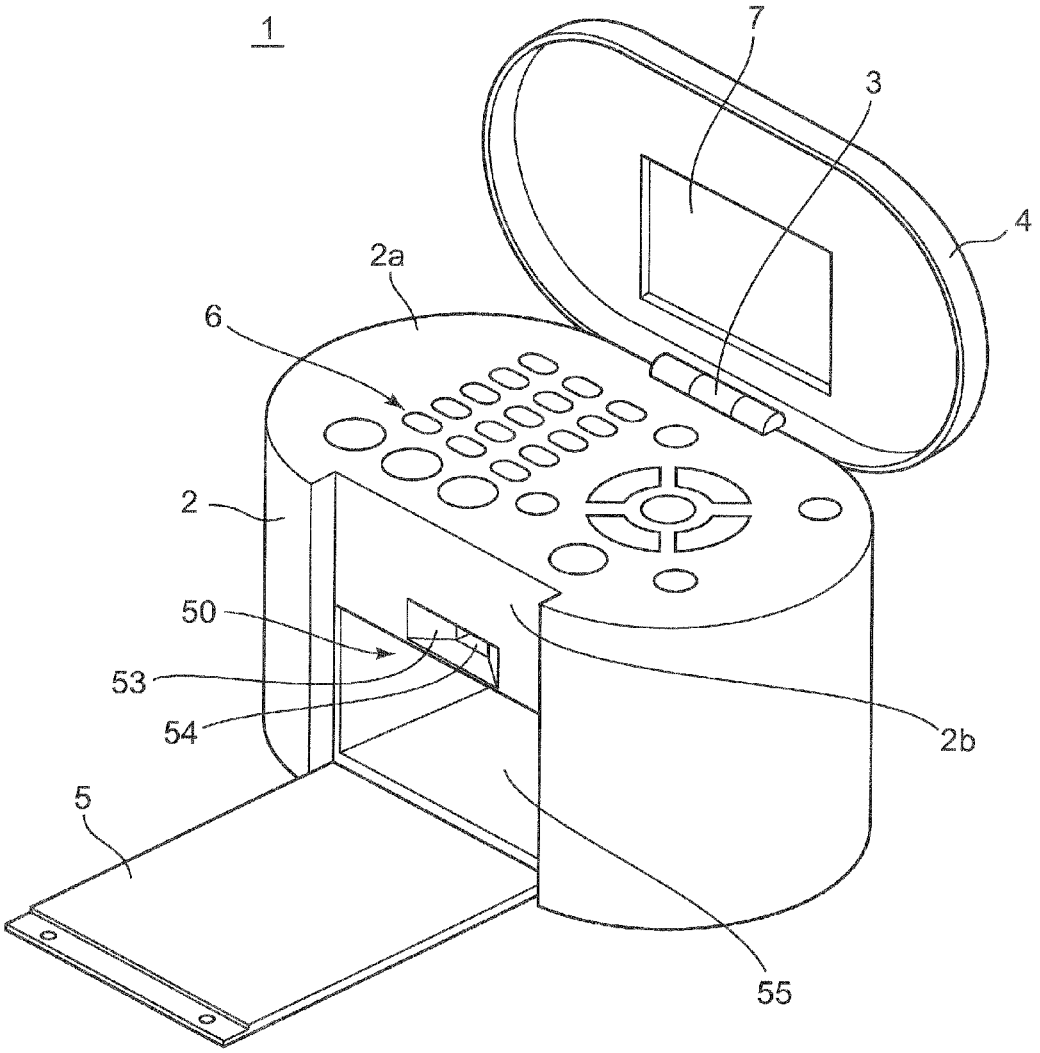
FIG. 1 is a perspective view showing an outer appearance of a nail print apparatus of the present invention.

FIG. 1 is a perspective view showing an outer appearance of a nail print apparatus 1 of the present invention.

As shown in FIG. 1, the nail print apparatus 1 includes a case 2, a hinge 3, a cover 4, an opening/closing plate 5, an operating board 6 and a displaying section 7.

From a planar view, the case 2 is formed in a shape such as an oval shape.

From a front view, the case 2 is formed in a shape such as a rectangular shape.

The operating board 6 is provided on an upper face 2*a* of the case 2. The operating board 6 is provided with, for example, a power source switch button which turns the power of the nail print apparatus 1 ON and OFF, and operation buttons to perform various input.

The hinge 3 is provided in a rear end section of the upper face 2*a* of the case 2. The cover 4 is linked rotatably to the rear end section of the upper face 2*a* of the case 2 by the hinge 3. The cover 4 is provided to be able to rotate from a state overlapped on the upper face 2*a* of the case 2 to a state standing on the upper face 2*a* of the case 2 with the hinge 3 as the supporting point.

A displaying section 7 is provided on an inner face of the cover 4. The displaying section 7 includes a liquid crystal display, an organic electroluminescence display and other flat displays.

The displaying section 7 appropriately displays, for example, a photographed fingernail image, an outline of a nail in the fingernail image, an outline of a finger in the fingernail image, an image to be printed on the nail, a thumbnail image for confirming a design, etc.

An opening section 2*b* is formed on the center section of the front face of the case 2. An end section of the opening/closing plate 5 is placed in the lower end section of the opening section 2*b*, the end section of the opening/closing plate 5 is linked rotatably to the front face lower end section of the case 2 with the hinge. The opening/closing plate 5 is provided to be able to rotate from a state standing and covering the opening section 2*b* to a state laid forward and opening the opening section 2*b* with the hinge as the supporting point.

Figure 2:
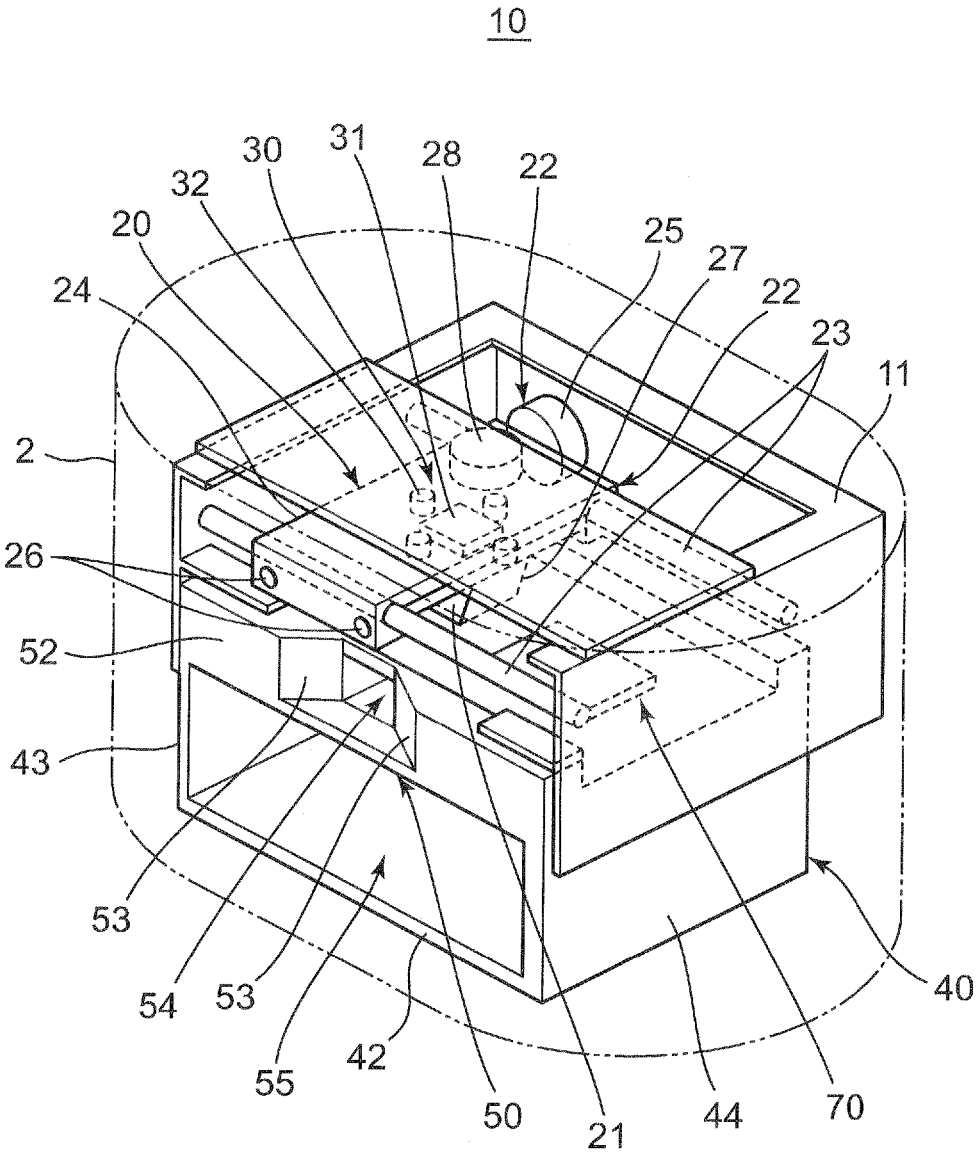
FIG. 2 is a perspective view of an inner configuration of the nail print apparatus of the present invention.

FIG. 2 is a perspective view showing an inner configuration of the nail print apparatus 1 of the present invention.

Figure 3:
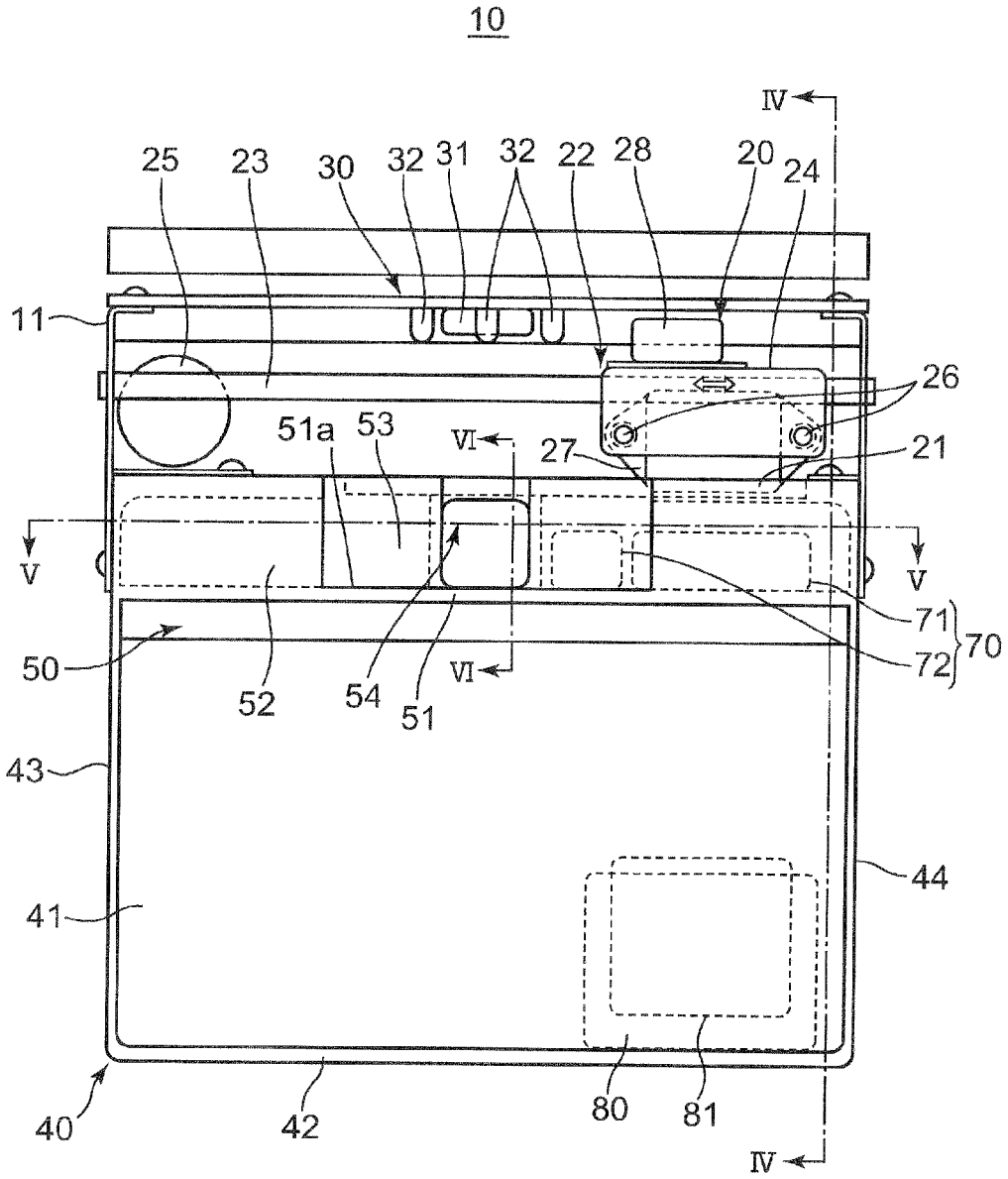
FIG. 3 is a front view of the inner configuration of the nail print apparatus of a first embodiment of the present invention.

FIG. 3 is a front view showing the inner configuration of the nail print apparatus 1 of the first embodiment of the present invention.

Figure 4:
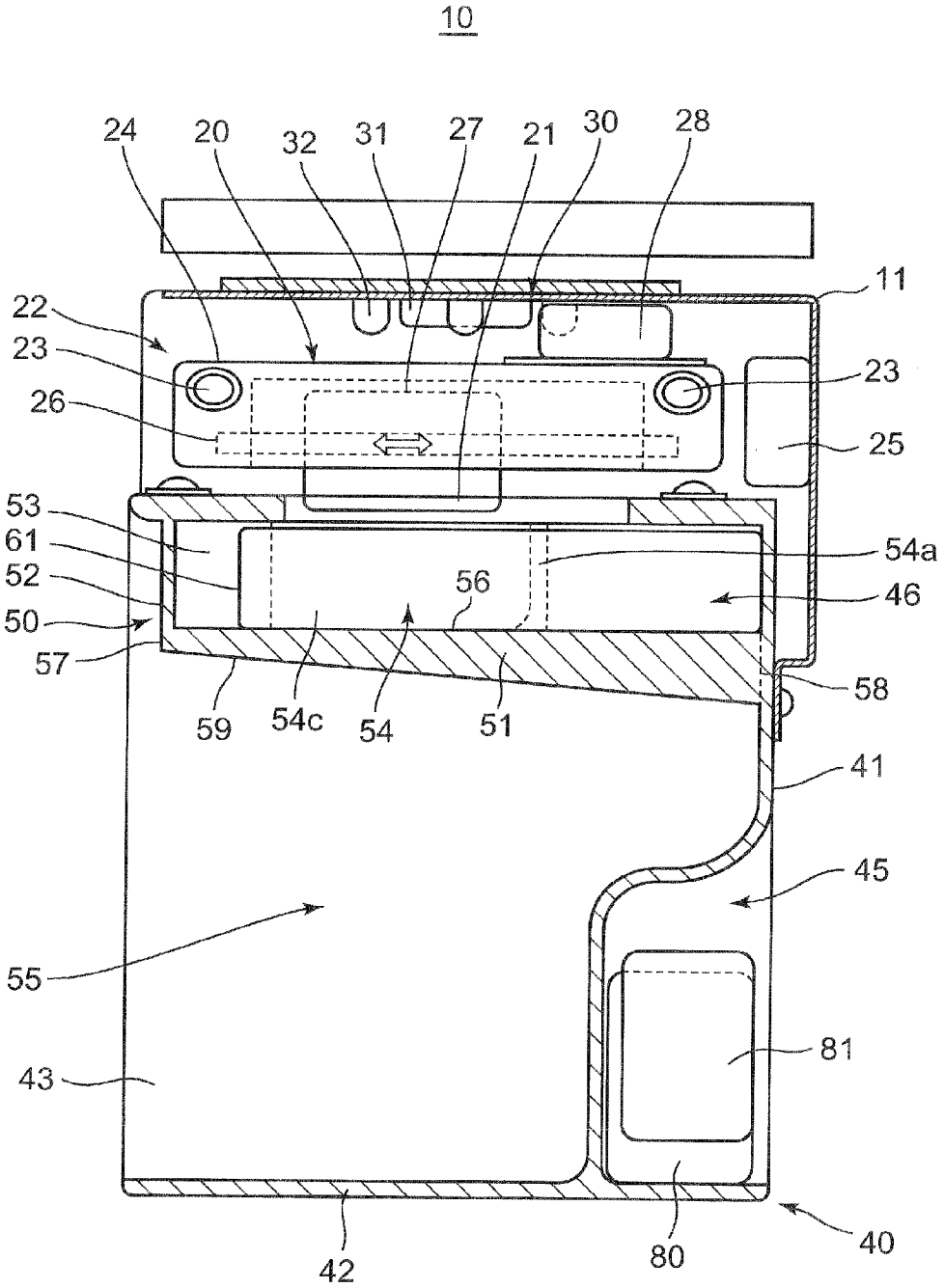
FIG. 4 is a cross sectional view of an apparatus main body of the nail print apparatus of the first embodiment showing a cross section along a cutting plane line IV-IV viewed in an arrow direction.

FIG. 4 is a cross sectional view of an apparatus main body 10 of the nail print apparatus 1 of the present embodiment showing a cross section along a cutting plane line IV-IV shown in FIG. 3 viewed in an arrow direction.

As shown in FIG. 2, the nail print apparatus 1 includes an apparatus main body 10, and the apparatus main body 10 is stored inside the case 2 and attached to the case 2.

Next, the apparatus main body 10 is specifically described with reference to FIG. 3 and FIG. 4.

The apparatus main body 10 includes an upper portion device casing 11, a printing section 20, a photographing section 30, a lower portion device casing 40, a finger fixing section 50, a print maintenance section 70, a cartridge mounting section 80 and the like.

The upper portion device casing 11 is provided in an upper portion inside the case 2. The lower portion device casing 40 is provided in a lower portion inside the case 2. The upper portion device casing 11 is provided on the lower portion device casing 40.

The printing section 20 is provided in the upper portion device casing 11.

The printing section 20 includes a printing head 21, and a moving device 22 which moves the printing head 21 to the front, rear, left and right.

The moving device 22 includes two main guide rods 23, a main carriage 24, a main scanning direction motor 25, two sub-guide rods 26, a sub-carriage 27 and a sub-scanning direction motor 28.

The printing head 21 is a printing head of an ink jet method in which ink is made into fine drops and ejected to a print target surface of a print target. The printing head 21 does not have to be a printing head of an ink jet method and can be a printing head of other printing methods.

When the printing head 21 is a printing head of the ink jet method, the printing head 21 is configured to be connected to a later described ink cartridge 81 through an ink supplying flow path and the printing head 21 can receive supply of ink from the ink cartridge 81. For example, each printing head 21 includes a nozzle array which sprays black ink, a nozzle array which sprays cyan ink, a nozzle array which sprays magenta ink, and a nozzle array which sprays yellow ink.

Two main guide rods 23 are provided parallel bridging left and right boards on both sides of the upper portion device casing 11 and the main guide rods 23 extend in the left and right direction.

The main carriage 24 is provided to the main guide rods 23 so as to be able to slide. The main carriage 24 is guided by the main guide rods 23 along the main guide rods 23.

The main scanning direction motor 25 is connected to the main carriage 24 through a transmission mechanism, and the main carriage 24 is driven left and right along the main guide rods 23 by forward and reverse rotation of the main scanning direction motor 25.

Two sub-guide rods 26 are provided parallel bridging the front section and the rear section of the main carriage 24 and the sub-guide rods 26 extend in the front and rear direction.

The sub-carriage 27 is provided to the sub-guide rods 26 so as to be able to slide. The sub-carriage 27 is guided by the sub-guide rods 26 along the sub-guide rods 26.

The sub-scanning direction motor 28 is connected to the sub-carriage 27 through a transmission mechanism, and the sub-carriage 27 is driven front and rear along the sub-guide rods 26 by forward and reverse rotation of the sub-scanning direction motor 28.

The printing head 21 is mounted to the sub-carriage 27.

The photographing section 30 includes an electronic camera 31 and a plurality of illuminating lights 32.

The electronic camera 31 and the illuminating lights 32 are provided on a lower face of a top plate of the upper portion device casing 11. The illuminating lights 32 are aligned so as to surround the electronic camera 31.

The electronic camera 31 is provided downward, and the electronic camera 31 captures the finger to be printed or the finger after printing placed below the electronic camera 31.

The illuminating lights 32 illuminate light downward and illuminate the photographing range below the electronic camera 31.

The lower portion device casing 40 and the finger fixing section 50 are provided as one.

First, the lower portion device casing 40 is described. The lower portion device casing 40 is provided in a substantial box shape with the upper face and the front face open. Specifically, the lower portion device casing 40 includes a back face plate 41, a base plate 42, a pair of left and right side plates 43 and 44 and a cartridge storing section 45.

The lower end section of the side plates 43 and 44 are each linked to both left and right end sections of the base plate 42, and the side plates 43 and 44 are provided in a state standing with respect to the base plate 42.

The back face plate 41 is connected to the rear section of the base plate 42 and the side plates 43 and 44 so as to cover the rear side of the region surrounded by the base plate 42 and the side plates 43 and 44.

The lower portion of the back face plate 41 is formed to be depressed toward the front side and the cartridge storing section 45 is formed between the rear side of the portion of the lower portion of the back face plate 41 depressed toward the front and the base plate 42.

A cartridge mounting section 80 is provided in the cartridge storing section 45. The ink cartridge 81 is mounted in the cartridge mounting section 80. The ink in the ink cartridge 81 is supplied to the printing head 21 through the cartridge mounting section 80, the hose and the like.

The finger fixing section 50 of the present embodiment is described with reference to FIG. 3 to FIG. 6.

Figure 5A:
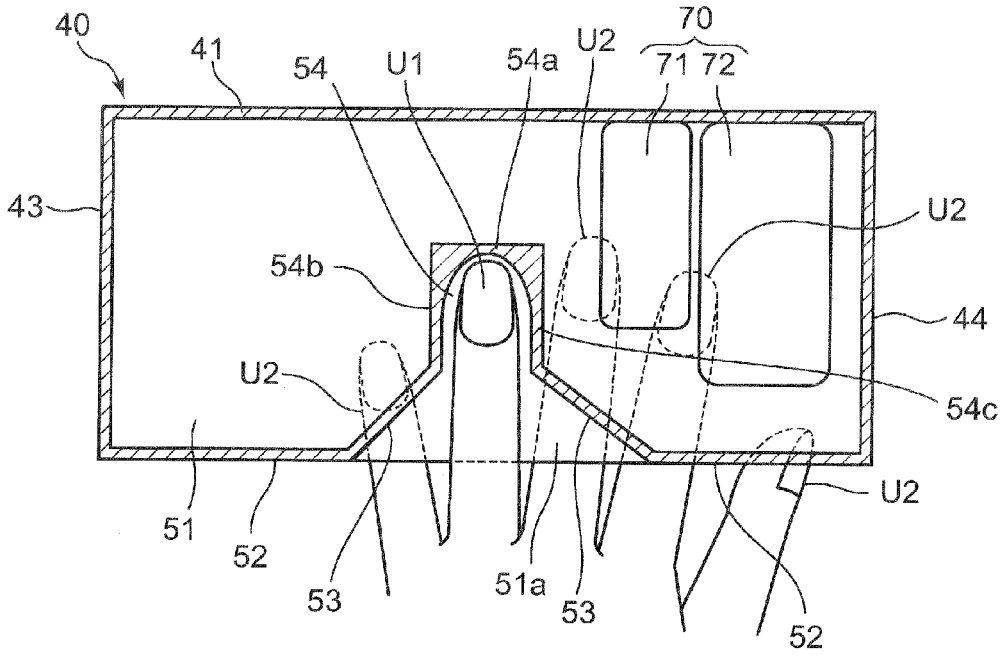
FIG. 5A and FIG. 5B are cross sectional views of the apparatus main body of the nail print apparatus of the first embodiment showing a cross section along a cutting plane line V-V viewed in the arrow direction and shows a state where a finger other than the thumb is inserted in a first finger receiving section.
Figure 5B:
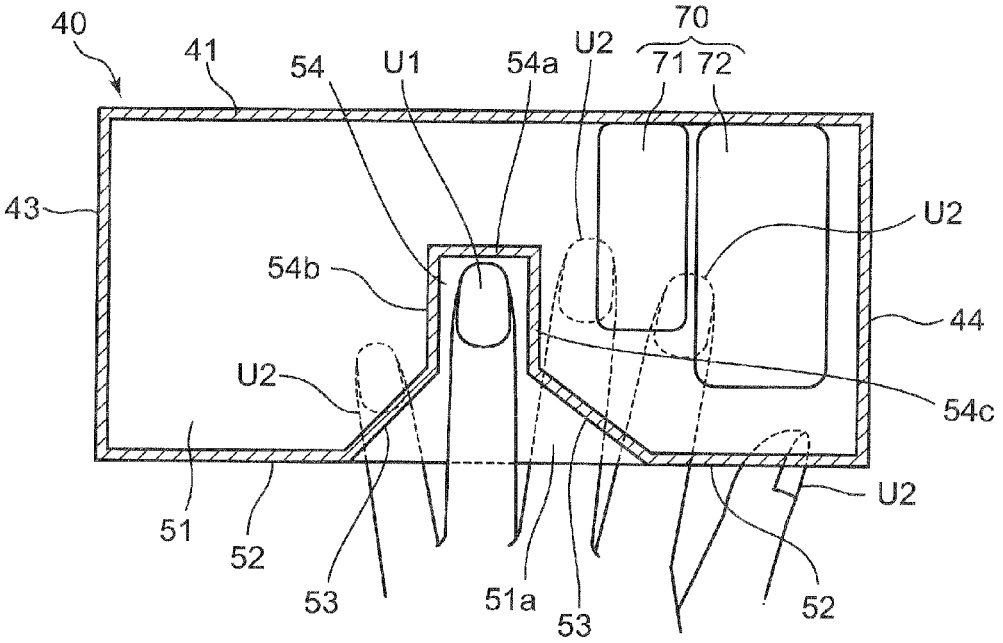

FIG. 5A and FIG. 5B are cross sectional views of the apparatus main body 10 of the nail print apparatus 1 of the present embodiment showing a cross section along a cutting plane line V-V shown in FIG. 3 viewed in the arrow direction and shows a state where a finger other than the thumb is inserted in the first finger receiving section, and FIG. 5A shows a first form of a shape of an inner surface of the first finger receiving section and FIG. 5B shows a second form of a shape of an inner surface of the first finger receiving section.

Figure 6A:
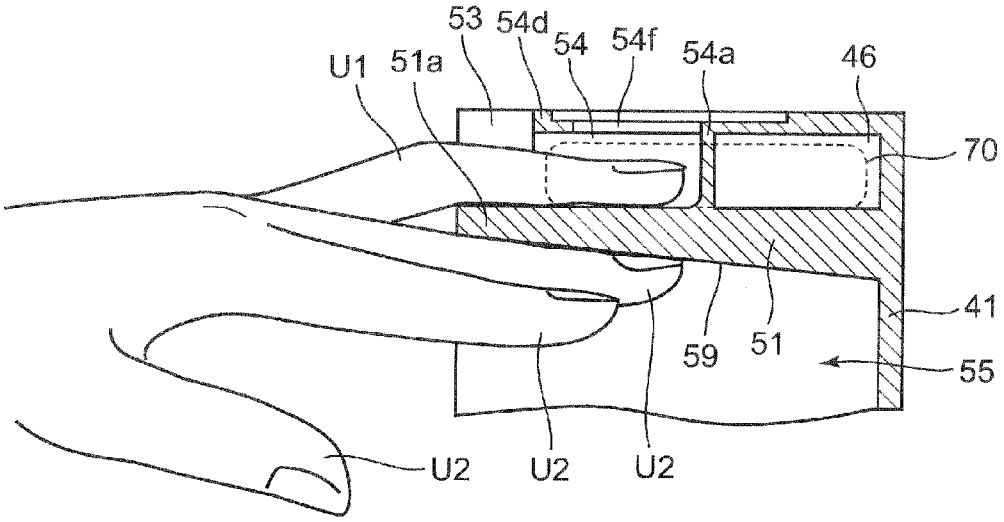
FIG. 6A and FIG. 6B are cross sectional views of the apparatus main body of the nail print apparatus of the first embodiment showing a cross section along a cutting plane line VI-VI viewed in the arrow direction.
Figure 6B:
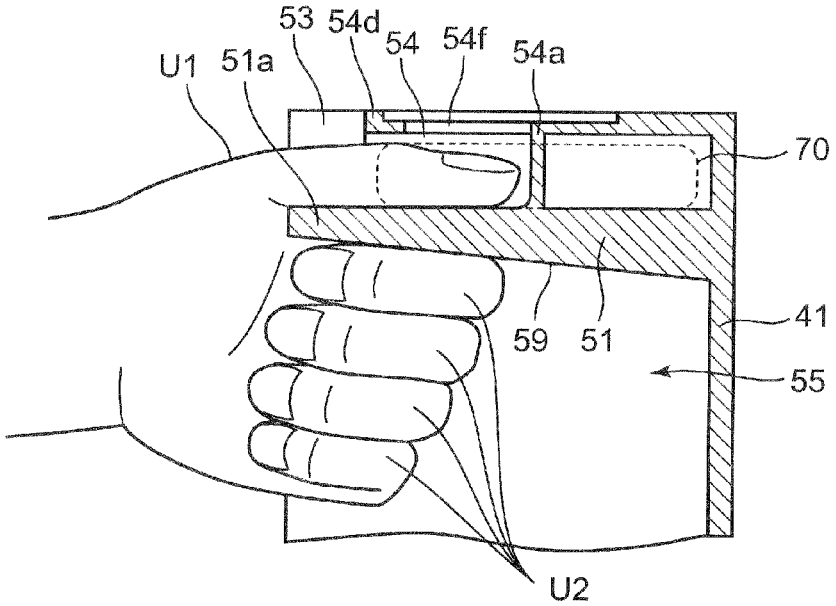

FIG. 6A and FIG. 6B are cross sectional views of the apparatus main body 10 of the nail print apparatus 1 of the present embodiment showing a cross section along a cutting plane line VI-VI shown in FIG. 3 viewed in the arrow direction, and FIG. 6A shows a state where a finger other than the thumb is inserted in the first finger receiving section and FIG. 6B shows a state where the thumb is inserted in the first finger receiving section.

The finger fixing section 50 of the present embodiment includes a partition wall 51, a projecting section 51b, a front wall section 52, a finger guiding section 53, a first finger receiving section (hereinafter referred to as print finger receiving section) 54, a striking section 54*a*, dividing sections 54*b* and 54*c*, a ceiling section 54*d*, a window section 54*f* and a second finger receiving section (non-print finger receiving section) 55.

The partition wall 51 is provided inside the lower portion device casing 40 so as to divide the space (space surrounded by the back face plate 41, the base plate 42 and the side plates 43 and 44) inside the lower portion device casing 40 between an upper portion and a lower portion. Here, the end section of the partition wall 51 on the side where the print finger receiving section 54 is open is to be a front end 57 and the end section on the opposite side to the front end 57 is to be a rear end 58.

In the partition wall 51, an upper surface 56 is provided substantially horizontal, both left and right end sections of the partition wall 51 are connected to the side plates 43 and 44, and the rear end 58 of the partition wall 51 is connected to the back face plate 41.

The region inside the lower portion device casing 40 is divided between an upper portion and a lower portion by the partition wall 51. In the regions inside the lower portion device casing 40, the non-print finger receiving section 55 is formed in a region divided by the partition wall 51 to be the lower side of the partition wall 51 and the print finger receiving section 54 and a storing section 46 are formed in a region divided by the partition wall 51 to be the upper side of the partition wall 51.

A printing section 20 is provided facing an upper surface 56 of the partition wall 51. Specifically, the main guide rods 23 and the sub-guide rods 26 of the printing section 20 are provided substantially parallel to the upper surface 56 of the partition wall 51 above the partition wall 51. The printing head 21 is moved by the moving device 22 to the front, rear, left and right along the upper surface 56 of the partition wall 51.

The non-print finger receiving section 55 formed on a side of the lower surface of the partition wall 51 is a hollow open to a side of the front end 57 of the partition wall 51. In the non-print finger receiving section 55, a region is formed for receiving a second finger (hereinafter referred to as non-print finger) U2 other than a first finger (hereinafter referred to as a print finger) U1 including the nail of the print target.

As shown in FIG. 4, the partition wall 51 has a shape with a thickness which is thin on a side of the front end 57 and which gradually increases toward a side of the rear end 58, in other words, the finger inserting direction. The shape of the cross-section of the partition wall 51 in the vertical direction is a tapered shape between the front end 57 and the rear end 58 from the rear end 58 toward the front end 57. With this, the lower surface of the partition wall 51 is an inclined surface 59 which is inclined toward the lower direction so that the thickness of the partition wall 51 gradually increases from a side of the front end 57 toward a side of the rear end 58. As described above, since the lower surface of the partition wall 51 is inclined toward the lower direction, it is easy to insert the print finger U1 to the print finger receiving section 54 and the non-print finger U2 to the non-print finger receiving section 55.

The front wall section 52 is linked to the front end 57 of the partition wall 51. The front wall section 52 is provided standing from the partition wall 51 so as to extend upward from the front end 57 of the partition wall 51. Both left and right end sections of the front wall section 52 are each linked to the side plates 43 and 44.

On the upper side of the partition wall 51 other than the print finger receiving section 54, the region surrounded by the front wall section 52, the back face plate 41, the side plates 43 and 44 and the partition wall 51 is the storing section 46.

The finger guiding section 53 is provided in the center section of the left and right direction of the front wall section 52 in a state depressed in the rear direction toward a side of the rear end 58 of the partition wall 51. The finger guiding section 53 forms a depressed shape where the width in the left and right direction gradually becomes smaller in the rear direction. A finger placing section 51*a* which is a portion of the partition wall 51 is provided on the lower side of the finger guiding section 53, and the upper surface 56 of the finger placing section 51*a* composes the base of the finger guiding section 53.

The print finger receiving section 54 is formed in the far side of the finger guiding section 53. The print finger receiving section 54 is open toward a side of the front end of the partition wall 51. The print finger receiving section 54 is in a shape of a cube with one face open, surrounded in the top, bottom, left, right and rear and open to the front. The inside of the shape of the cube is to be a size so that one print finger U1 including the nail of the print target can be inserted.

Specifically, the lower side of the print finger receiving section 54 is divided by a portion of the partition wall 51. The far side of the print receiving section 54 is divided by the striking section 54*a*. Both left and right sides of the print finger receiving section 54 are divided by each of the dividing sections 54*b* and 54*c*. The upper side of the print finger receiving section 54 is divided by the ceiling section 54*d*. The print finger receiving section 54 is surrounded by the partition wall 51, the striking section 54*a*, the dividing sections 54*b* and 54*c* and the ceiling section 54*d*.

The striking section 54*a* is provided standing on the upper surface 56 of the partition wall 51 in a position separated to the rear from the far portion of the finger guiding section 53. As shown in FIG. 6A and FIG. 6B, when the print finger U1 is inserted in the print finger receiving section 54 to the farthest point, the tip of the print finger U1 comes into contact with the striking section 54*a*.

The dividing sections 54*b* and 54*c* are provided standing on the upper surface 56 of the partition wall 51 between the far portion of the finger guiding section 53 and the striking section 54*a* with a space on the left and the right. The rear end of the dividing sections 54*b* and 54*c* are connected to the striking section 54*a*. The front end of the dividing sections 54*b* and 54*c* are connected to the rear end of the finger guiding section 53 of the front wall section 52. The ceiling section 54*d* covers the top of the region surrounded by the striking section 54*a* and the dividing sections 54*b* and 54*c*.

The planar shape of the cross section of the inner surface of the print finger receiving section 54 formed by the striking section 54*a* and the dividing sections 54*b* and 54*c* can be, for example, a curved shape along the roundness of the tip side of the print finger U1 as shown in FIG. 5A.

The shape can also be a shape bent in a substantial right angle as shown in FIG. 5B.

When the inner surface of the print finger receiving section 54 is a curved shape along the roundness of the tip side of the print finger U1 as shown in FIG. 5A, the position of the print finger U1 inside the print finger receiving section 54 becomes more stable compared to the shape shown in FIG. 5B. Therefore, the shape as shown in FIG. 5A is preferable.

Next, the method of inserting each finger in the print finger receiving section 54 and the non-print finger receiving section 55 of the present embodiment is described.

For example, as shown in FIG. 5A and FIG. 6A, when the ring finger of the left hand is the print finger U1, the ring finger which is the print finger U1 is inserted in the print finger receiving section 54 on the upper side of the partition wall 51. The thumb, the index finger, the middle finger, and the little finger which are the non-print fingers U2 are inserted in the non-print finger receiving section 55 on the lower side of the partition wall 51. In this case, the thumb, the index finger, the middle finger and the little finger which are the non-print fingers U2 can be stretched as shown in FIG. 5A and FIG. 6A or can be bent in the non-print finger receiving section 55.

Alternatively, as shown in FIG. 6B, when the thumb is the print finger U1, the thumb which is the print finger U1 is inserted in the print finger receiving section 54 on the upper side of the partition wall 51.

The index finger, the middle finger, the ring finger and the little finger which are the non-print fingers U2 are inserted in the non-print finger receiving section 55 on the lower side of the partition wall 51.

In this case, the index finger, the middle finger, the ring finger and the little finger which are the non-print fingers U2 can be clenched as shown in FIG. 6B or the non-print fingers U2 can be stretched in the non-print finger receiving section 55.

As described above, when the print finger U1 is inserted in the print finger receiving section 54 on the upper side of the partition wall 51, the non-print fingers U2 are inserted in the non-print finger receiving section 55 on the lower side of the partition wall 51, and the finger placing section 51*a* is held between the print finger U1 and the non-print finger U2. With this, the print finger U1 is stably fixed.

As shown in FIG. 6A and FIG. 6B, a window section 54*f* is formed in the ceiling section 54*d* with an opening penetrating in the up and down direction. For example, when the print finger U1 is inserted in the print finger receiving section 54 so that the tip of the print finger U1 is in contact with the striking section 54*a*, the nail of the print finger U1 is exposed through the window section 54*f*.

As shown in FIG. 3 and FIG. 4, the photographing section 30 including the electronic camera 31 and the illuminating lights 32 are provided on the lower surface of the top plate of the upper portion device casing 11 above the window section 54*f*.

The nail of the print finger U1, which is inserted in the print finger receiving section 54 and exposed from the window section 54*f*, is illuminated with the illuminating lights 32 and imaged with the electronic camera 31.

From a planar view, the window section 54*f* is within the moving range of the printing head 21 moved by the moving device 22.

The ceiling section 54*d* is provided above the partition wall 51 and below the main carriage 24 and the sub-carriage 27 of the moving device 22.

The print maintenance section 70 is stored in the storing section 46.

The print maintenance section 70 is provided in a position which is the same height as the position where the print finger receiving section 54 is provided and in a position opposite to the non-print finger receiving section 55 with the partition wall 51 in between.

In a planar view, the print maintenance section 70 is within the moving range of the printing head 21 moved by the moving device 22.

The print maintenance section 70 includes, for example, a head cleaning/cap mechanism 71 or an ink disposing section 72, or both.

The head cleaning/cap mechanism 71 performs, for example, cleaning of the printing head 21 or covers a cap on the printing head 21 when the printing head 21 is not used in order to maintain a moisture state of the printing head 21.

The ink disposing section 72, for example, receives excess ink ejected from the printing head 21 in order to maintain the state of the nozzle of the printing head 21 in a suitable state.

Here, the head cleaning/cap mechanism 71 is described, however, a head cleaning mechanism and a cap mechanism can be provided separately independently.

The operation and the method of use of the nail print apparatus 1 of the present embodiment configured as described above is described.

First, the user operates the operating board 6 to start the nail print apparatus 1 and to set the print design, etc.

Next, as shown in FIG. 6A, the user inserts any of the fingers of the hand among the index finger, the middle finger, the ring finger and the little finger as the print finger U1, and the finger is inserted in a stretched state from the finger guiding section 53 to the print finger receiving section 54 with the nail of the finger facing up. The finger other than the above is inserted in the non-print finger receiving section 55 as the non-print finger U2. The finger inserted in the non-print finger receiving section 55 can be stretched or bent.

Here, the left and right width of the finger guiding section 53 becomes gradually smaller toward the rear direction. Therefore, when the print finger U1 is inserted in the finger guiding section 53, the fingertip of the print finger U1 is guided by the finger guiding section 53 to the print finger receiving section 54. The user inserts the print finger U1 in the print finger receiving section 54 so that the nail of the print finger U1 inserted in the print finger receiving section 54 is positioned below the window section 54*f*. Here, for example, the tip of the print finger U1 is in a state in contact with the striking section 54*a*. The print finger U1 is to be inserted so that the nail of the print finger U1 in the print finger receiving section 54 is positioned below the window section 54*f* and the tip of the print finger U1 may or may not be in contact with the striking section 54*a*.

As described above, when the user inserts any of the index finger, the middle finger, the ring finger, and the little finger in the print finger receiving section 54 as the print finger U1, and the user inserts the other finger in the non-print finger receiving section 55 as the non-print finger U2, the print finger U1 can be inserted in the print finger receiving section 54 in a stretched state and the non-print finger U2 can be inserted in the non-print finger receiving section 55 in a stretched state. Therefore, the user can keep the fingers in a relaxed state while the printing is performed on the nail and the user does not feel stress.

When the print finger U1 is inserted in the print finger receiving section 54 and the non-print finger U2 is inserted in the non-print finger receiving section 55, the finger placing section 51*a* which is a portion of the partition wall 51 is held in between the print finger U1 inserted in the print finger receiving section 54 and the non-print finger U2 inserted in the non-print finger receiving section 55. Therefore, the print finger U1 inserted in the print finger receiving section 54 is stably fixed and the printing on the nail of the print finger U1 can be preferably performed.

The cross section of the finger placing section 51a in a vertical direction is in a tapered shape from a side of the rear end 58 toward a side of the front end 57. Since a side of the front end 57 is thin and the lower surface is an inclined surface 59 inclined toward the lower direction, excessive force is not provided to widen the space between the print finger U1 and the non-print finger U2 when the finger placing section 51*a* is held between the print finger U1 inserted in the print finger receiving section 54 and the non-print finger U2 inserted in the non-print finger receiving section 55. Therefore, the user can insert the fingers in the print finger receiving section 54 and the non-print finger receiving section 55 in an easy state and printing on the nail of the print finger U1 can be performed in a natural state without pressure or stress.

Then, the nail of the print finger U1 inserted in the print finger receiving section 54 and exposed from the window section 54*f* is photographed with the electronic camera 31 in a state illuminated with the illuminating lights 32. With this, the computer of the nail print apparatus 1 recognizes the position, size, range, etc. of the nail portion of the print finger U1.

Next, the printing section 20 prints on the nail of the print finger U1 inserted in the print finger receiving section 54.

Specifically, the moving device 22 moves the printing head 21 to the front, rear, left and right and the printing head 21 ejects ink on the finger nail to print an image including a pre-set pattern or design on the nail of the print finger U1.

For example, when the printing head 21 ejects ink on the nail of the finger, the moving device 22 can stop the movement of the printing head 21.

The moving device 22 moves the printing head 21 on the print maintenance section 70 as necessary and the head cleaning/cap mechanism 71 may clean the printing head 21 or the printing head 21 may eject excess ink to the ink disposing section 72.

After printing ends, the user pulls out the print finger U1 from the print finger receiving section 54 and the non-print finger U2 from the non-print finger receiving section 55.

Next, the user inserts another finger which is not printed among the index finger, the middle finger, the ring finger and the little finger as the print finger U1 and inserts the finger in the finger guiding section 53 and the print finger receiving section 54 with the nail of the finger facing up. The finger other than the above is inserted in the non-print finger receiving section 55 as the non-print finger U2. Then, the printing section 20 similarly prints on the nail of the printing finger U1 as described above.

As described above, the nails of the index finger, the middle finger, the ring finger and the little finger are printed sequentially.

When the thumb is the print finger U1, the thumb is inserted in the finger guiding section 53 and the print finger receiving section 54 with the nail of the thumb facing up, and the index finger, the middle finger, the ring finger and the little finger are inserted in the non-print finger receiving section 55. Then, the printing section 20 similarly prints on the nail of the thumb.

The order of printing on the thumb, the index finger, the middle finger, the ring finger and the little finger can be determined freely.

Next a modification of the present embodiment is described.

In the configuration described above, one print finger receiving section 54 in which one finger can be inserted as the print finger U1 is provided on the upper surface 56 of the partition wall 51, however the present invention is not limited to the above configuration.

For example, plural number of fingers of two or more can be inserted together as the print fingers U1 in the print finger receiving section 54 provided on the upper surface 56 of the partition wall 51 and the printing can be performed successively on the inserted plurality of finger nails.

Figure 7A:
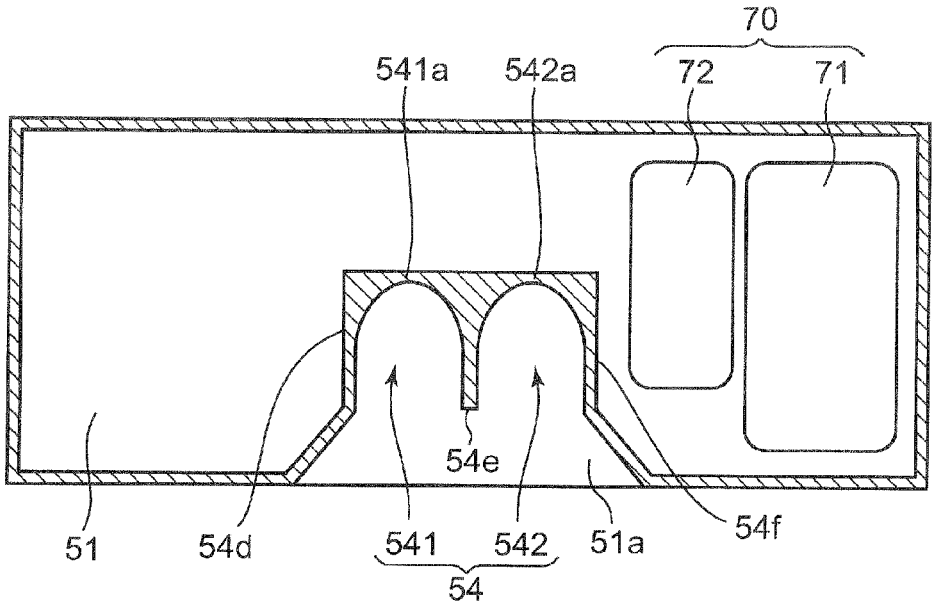
FIG. 7A and FIG. 7B show a modification of the first finger receiving section of the first embodiment.
Figure 7B:
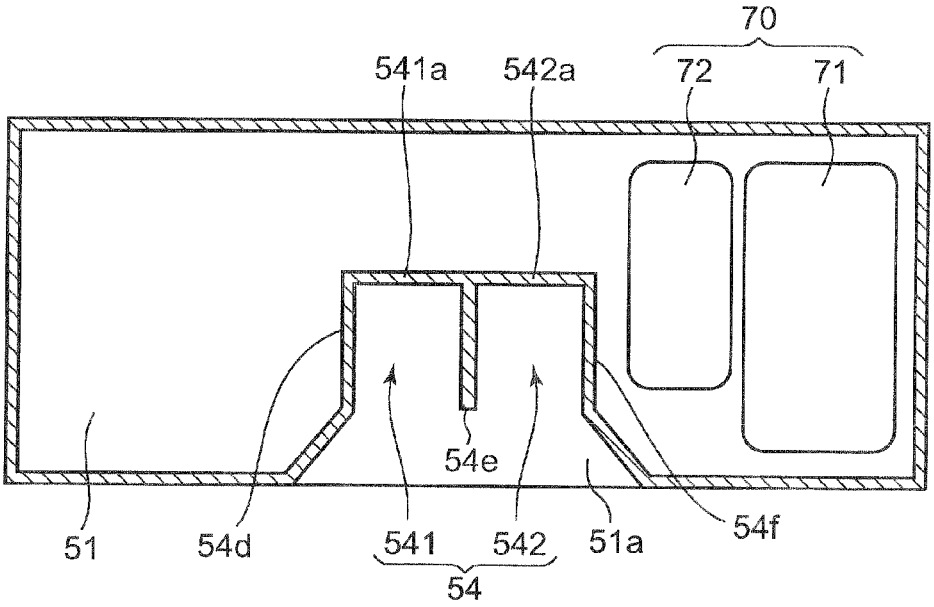

FIG. 7A and FIG. 7B show an example of a form when it is possible to insert two fingers together as the print finger U1 in the print finger receiving section 54 provided on the upper surface 56 of the partition wall 51 as a modification of the present embodiment, and FIG. 7A is a diagram showing a first form of the modification of the print finger receiving section and FIG. 7B is a diagram showing a second form of the modification of the print finger receiving section.

In this case, as shown in FIG. 7A, a first print finger receiving section 541 and a second print finger receiving section 542 composing the print finger receiving section 54 are provided adjacent to each other on the upper surface 56 of the partition wall 51. A finger is inserted in each of the first print finger receiving section 541 and the second print finger receiving section 542. With this, two fingers can be inserted together on the partition wall 51 as the print finger U1.

In this form, for example, side faces of adjacent fingers of one hand can be put close together to insert each finger in the first print finger receiving section 541 and the second print finger receiving section 542, and the other non-print fingers can be inserted in the non-print finger receiving section 55. With this, nails of two adjacent fingers of one hand can be successively printed.

Alternatively, side faces of thumbs of both hands can be put close together to insert each thumb in the first print finger receiving section 541 and the second print finger receiving section 542, and the other non-print fingers of both hands can be inserted in the non-print finger receiving section 55. With this, nails of thumbs of both hands can be successively printed.

Side faces of index fingers of both hands can be put close together to insert each index finger in the first print finger receiving section 541 and the second print finger receiving section 542, and the other non-print fingers of both hands can be inserted in the non-print finger receiving section 55. With this, nails of index fingers of both hands can be successively printed.

Here, the planar shape of the cross section of the inner surface of the first print finger receiving section 541 formed by the striking section 541*a* and the dividing sections 54*d* and 54*e* and the planar shape of the cross section of the inner surface of the second print finger receiving section 542 formed by the striking section 542*a* and the dividing sections 54*e* and 54*f* can be a curved shape along the roundness of the tip side of the print finger U1 as shown in FIG. 7A. The shape can be a shape bent in a substantial right angle as shown in FIG. 7B. When the inner surface of the first and the second print finger receiving sections 541 and 542 is a curved shape along the roundness of the tip side of the print finger U1 as shown in FIG. 7A, the position of the print finger U1 inside the first and the second print finger receiving sections 541 and 542 becomes more stable compared to the shape shown in FIG. 7B. Therefore, the shape as shown in FIG. 7A is preferable.

In the above embodiment, the printing related component such as the printing maintenance section 70 is placed in the position at the same height as the position where the print finger receiving section 54 is provided and in a position opposite to the non-print finger receiving section 55. Alternatively, the printing related auxiliary component such as the ink cartridge 48, etc. can be placed in the position at the same height as the position where the print finger receiving section 54 is provided and in a position opposite to the non-print finger receiving section 55.

According to the nail print apparatus of the first embodiment, the following advantageous effects can be achieved.

(1) In a configuration where the user inserts one finger as the print finger in the print finger receiving section in a stretched state to print a desired image on a nail of a finger inserted in the print finger receiving section, the user can insert the non-print fingers other than the print finger in the non-print finger receiving section in a stretched state. Therefore, the user can keep the finger in a relaxed state while printing.

(2) Since the user holds the partition wall in between the print finger inserted in the print finger receiving section and the non-print finger inserted in the non-print finger receiving section, the finger inserted in the print finger receiving section is stably fixed and printing on the nail of the print finger can be preferably performed. Since the thickness of the partition wall is thin at the front end and the thickness gradually increases toward the finger inserting section, excessive force is not provided to the fingers when the partition wall is held between the print finger and the non-print finger. Therefore, printing on the nail of the print finger can be performed in a natural state without applying pressure or stress to the user.

(3) The partition wall is formed not only below the print finger receiving section but also below the surrounding region of the print finger receiving section. A storing section is formed in the surrounding region of the print finger receiving section on the partition wall and the print maintenance section is provided in the storing section. Therefore, the entire nail print apparatus can be made smaller.

In the above described embodiment, the nail of the finger of the hand is the print target surface and the above embodiment describes inserting the finger of the hand in the print finger receiving section 54 and the non-print finger receiving section 55. However, the present invention is not limited to the above embodiment. For example, the nail of a toe of a foot can be the print target surface and the toe of the foot can be inserted in the print finger receiving section 54 and the non-print finger receiving section 55. In this case, effects similar to those described above can be achieved.

<Second Embodiment>

The second embodiment of the nail print apparatus of the present invention is described with reference to the drawings.

The same reference numerals are applied to the components similar to those of the first embodiment and the description is omitted or simplified. The points different from the first embodiment are described.

The finger fixing section 50 of the present embodiment is described with reference to FIG. 8 to FIG. 11.

Figure 8:
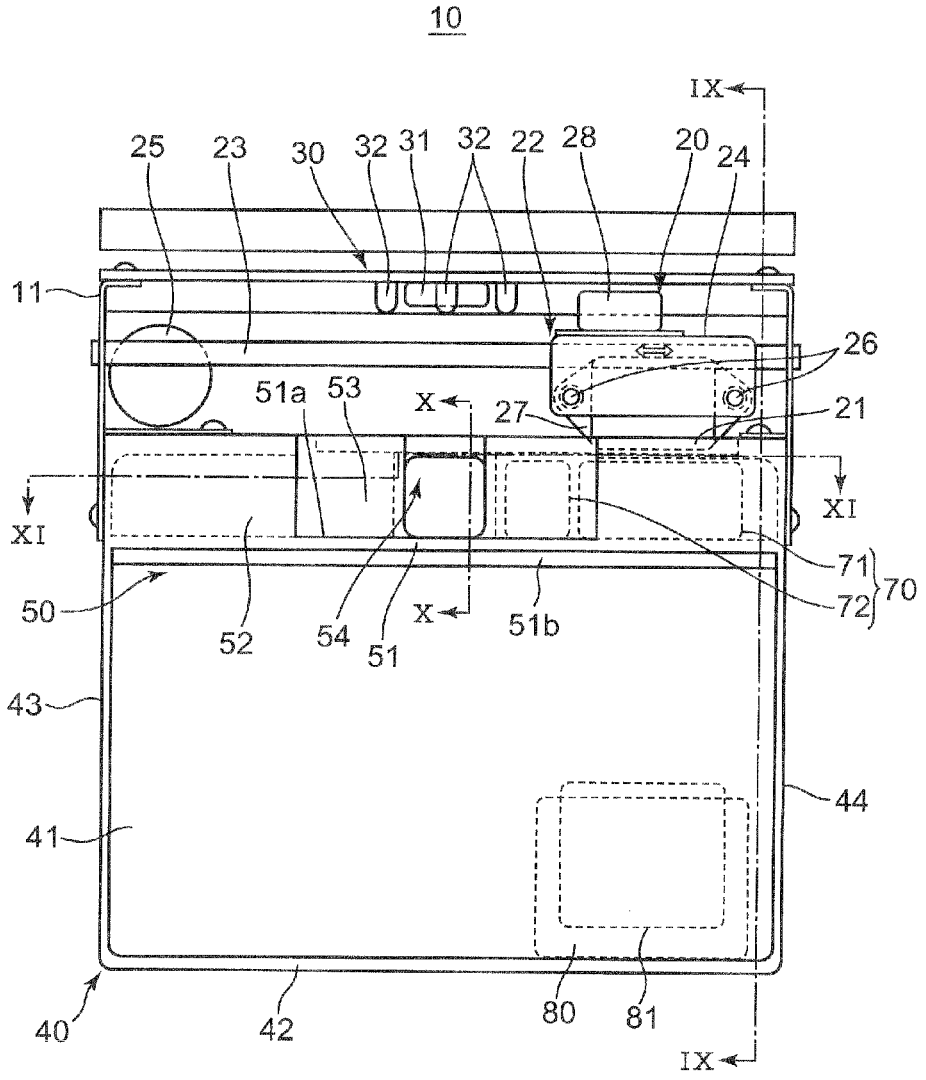
FIG. 8 is a front view showing an inner configuration of a nail print apparatus of the second embodiment of the present invention.

FIG. 8 is a front view showing an inner configuration of a nail print apparatus 1 of the second embodiment of the present invention.

Figure 9:
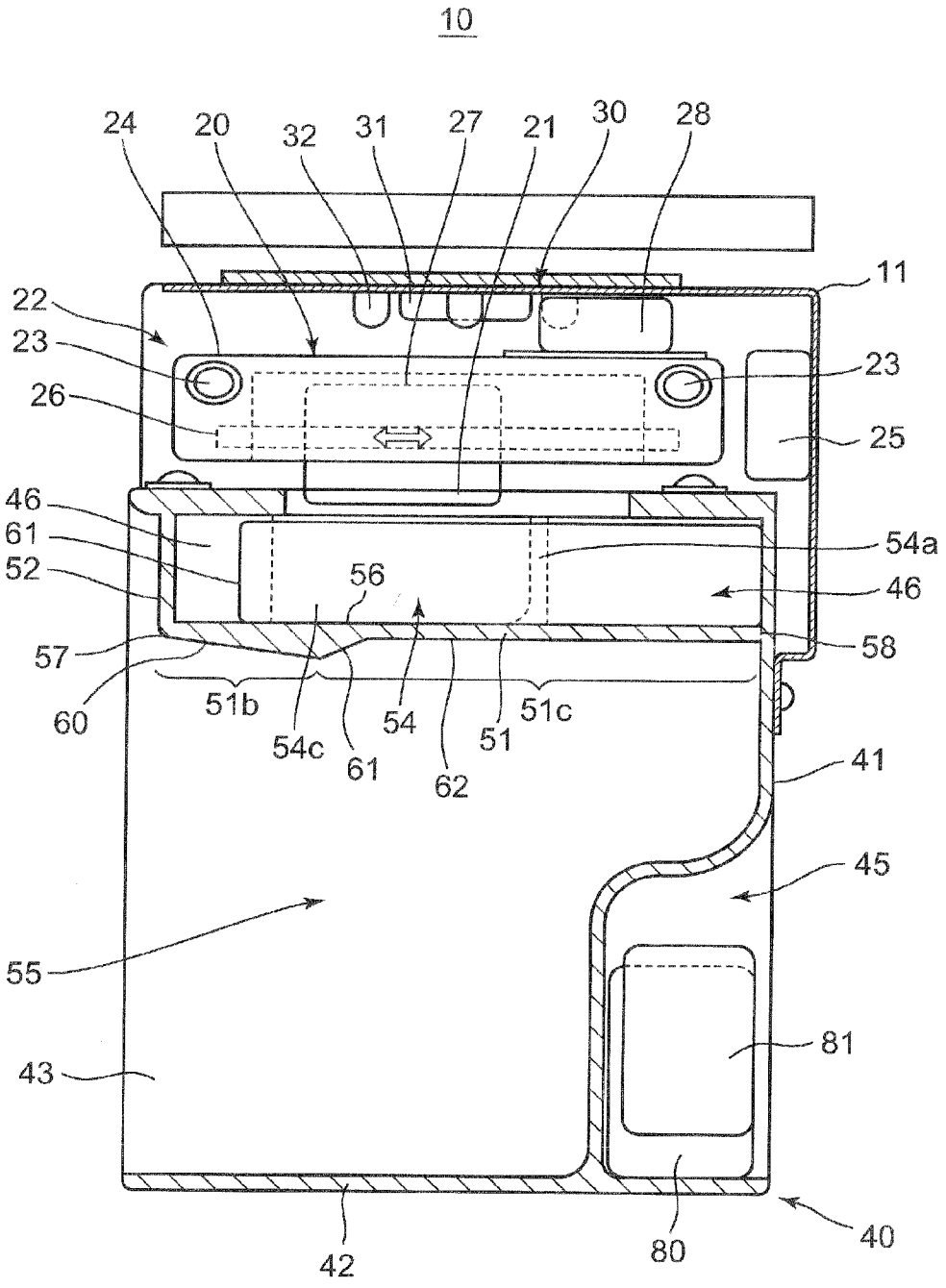
FIG. 9 is a cross sectional view of an apparatus main body of the nail print apparatus of the second embodiment showing a cross section along a cutting plane line IX-IX viewed in an arrow direction.

FIG. 9 is a cross sectional view of an apparatus main body 10 of the nail print apparatus 1 of the present embodiment showing a cross section along a cutting plane line IX-IX shown in FIG. 8 viewed in an arrow direction.

Figure 10:
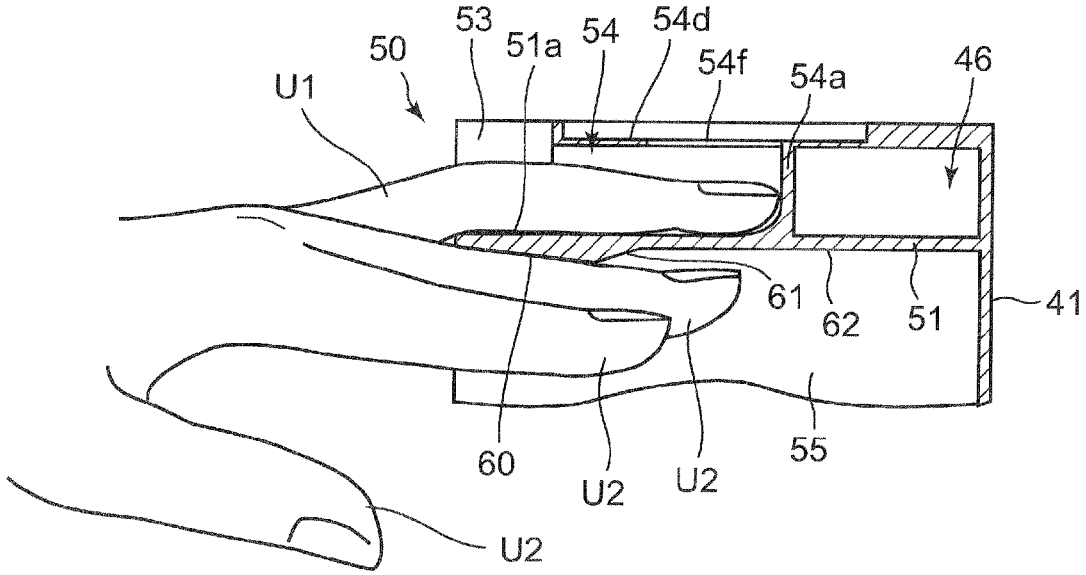
FIG. 10 is a cross sectional view of the apparatus main body of the nail print apparatus of the second embodiment showing a cross section along a cutting plane line X-X viewed in the arrow direction and shows a state where a finger other than the thumb is inserted in a first finger receiving section.

FIG. 10 is a cross sectional view of the apparatus main body 10 of the nail print apparatus 1 of the present embodiment showing a cross section along a cutting plane line X-X shown in FIG. 8 viewed in the arrow direction and shows a state where a finger other than the thumb is inserted in the print finger receiving section.

Figure 11:
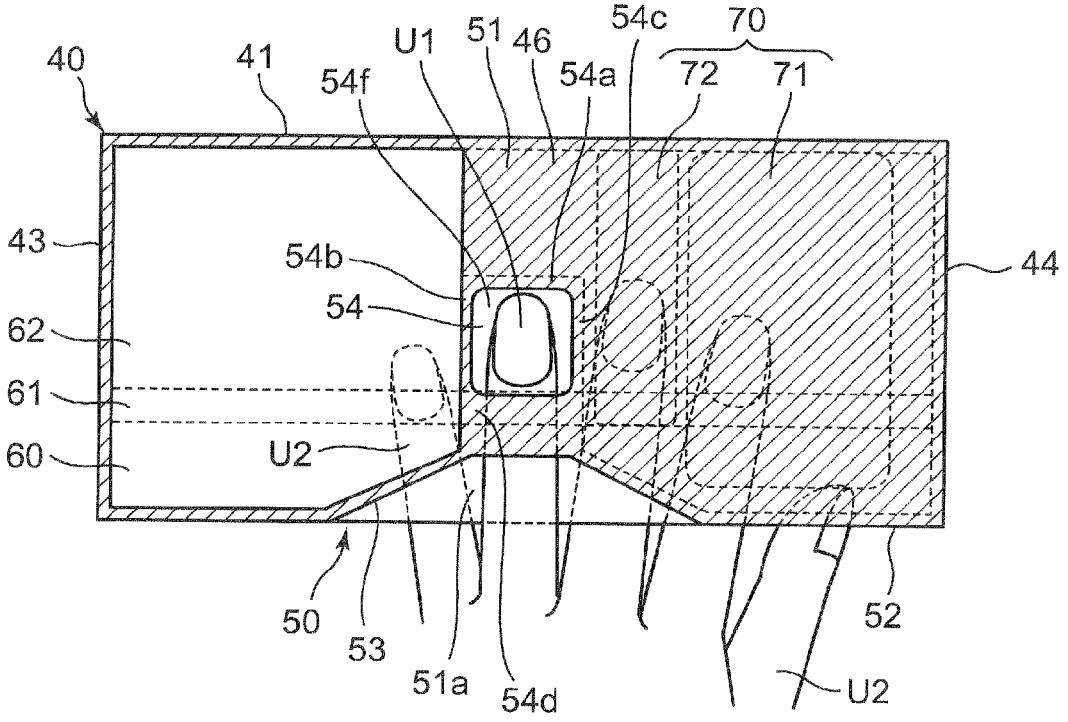
FIG. 11 is a cross sectional view of the apparatus main body of the nail print apparatus of the second embodiment showing a cross section along a cutting plane line XI-XI viewed in the arrow direction and shows a state where a finger other than the thumb is inserted in a first finger receiving section.

FIG. 11 is a cross sectional view of the apparatus main body 10 of the nail print apparatus 1 of the present embodiment showing a cross section along a cutting plane line XI-XI shown in FIG. 8 viewed in the arrow direction and shows a state where a finger other than the thumb is inserted in the print finger receiving section.

The finger fixing section 50 of the present embodiment includes a partition wall 51, a projecting section 51*b*, a depressed section 51*c*, a front wall section 52, a finger guiding section 53, a print finger receiving section 54, a striking section 54*a*, dividing sections 54*b* and 54*c*, a ceiling section 54*d*, a window section 54*f*, a non-print finger receiving section 55, and the like.

As shown in FIG. 9 and FIG. 10, a projecting section 51*b* is formed on a side of the front end 57 of the lower surface of the partition wall 51. A depressed section 51*c* is formed on a side of the rear end 58 of the projecting section 51*b* on the lower surface of the partition wall 51.

The projecting section 51*b* is a shape in which the thickness of the partition wall 51 on a side of the front end 57 side is thin and the thickness gradually increases toward a side of the rear end 58, in other words, the finger inserting direction. The shape of the cross section of the projecting section 51*b* in the vertical direction is a tapered shape from a side of the rear end 58 toward a side of the front end 57. The region of the lower surface of the partition wall 51 where the projecting section 51*b* is formed is to be an inclined surface 60 inclined toward the lower direction in which the thickness of the partition wall 51 gradually increases toward a side of the rear end 58. The projecting section 51*b* can be a configuration where the entire configuration has a thickness which is thicker than the thickness of the partition wall 51 at a flat surface 62 on a side of the rear end 58 of the depressed section 51*c* of the partition wall 51.

The projecting section 51*b* is formed throughout almost the entire left and right width direction of the partition wall 51 and the center section of the projecting section 51*b* in the left and right direction is a finger placing section 51*a*.

The depressed section 51*c* composes the far side of the upper portion of the non-print finger receiving section 55 and the depressed section 51*c* and the non-print finger receiving section 55 form a space as one.

As described above, the lower surface of the partition wall 51 in the projecting section 51*b* formed in a side of the front end 57 of the partition wall 51 is an inclined surface 60 inclined in the lower direction from a side of the front end 57 toward a side of the rear end 58. Therefore, the print finger can be easily inserted in the print finger receiving section 54 and the non-print finger can be easily inserted in the non-print finger receiving section 55.

As shown in FIG. 9, the lower surface of the partition wall 51 of the depressed section 51*c* formed on a side of the rear end 58 of the projecting section 51*b* includes a depressed surface 61 connected to the inclined surface 60 and including a shape depressed to a side of the upper surface 56 and a flat surface 62 connected to a side of the rear end 58 of the depressed surface 61 and including a substantial flat shape. In the flat surface 62, the partition wall 51 has a substantially even thickness and the thickness is thinner than the thickest portion of the projecting section 51*b*.

As shown in FIG. 10, the depressed surface 61 of the depressed section 51*c* is provided in a position corresponding to the nail of the non-print finger U2 when the non-print finger U2 is inserted in the non-print finger receiving section 55 in a stretched state. With this, when the non-print finger U2 is inserted in a stretched state in the non-print finger receiving section 55, the nail of the non-print finger U2 does not come into contact with the lower surface of the partition wall 51.

Next, the method of inserting each finger to the print finger receiving section 54 and the non-print finger receiving section 55 of the present embodiment is described.

As shown in FIG. 10 and FIG. 11, when the ring finger of the left hand is the print finger U1, the ring finger which is the print finger U1 is inserted in the print finger receiving section 54 on the upper side of the partition wall 51. The thumb, the index finger, the middle finger and the little finger which are the non-print fingers U2 are inserted in the non-print finger receiving section 55 on the lower side of the partition wall 51. With this, the finger placing section 51*a* formed with the projecting section 51*b* is held between the print finger U1 and the non-print finger U2. With this, the print finger U1 is stably fixed.

In this case, the thumb, the index finger, the middle finger and the little finger which are the non-print fingers U2 can be stretched in the non-print finger receiving section 55 as shown in FIG. 10 and FIG. 11 or the non-print fingers U2 can be bent. However, when the finger with a nail on which printing is already performed is inserted in the non-print finger inserting section 55 as the non-print finger U2, and the ink printed on the nail is not completely dry, it is preferable that the fingers are extended in the non-print finger receiving section 55 are stretched so that the printed design is not damaged or does not peel off by the printed nails coming into contact with each other.

In the present embodiment, a depressed surface 61 of the depressed section 51*c* is formed on a side of the rear end 58 of the projecting section 51*b* on the lower surface of the partition wall 51. Therefore, the nail of the non-print finger U2 stretched in the non-print finger receiving section 55 does not come into contact with the lower surface of the partition wall. Therefore, even when the finger including the nail on which printing is already performed is inserted in the non-print finger receiving section 55 as the non-print finger U2 and the ink printed on the nail is not dry, the printed nail does not come into contact with the lower surface of the partition wall and the printed design is not damaged and does not peel off.

The operation and the method of using the nail print apparatus 1 of the present embodiment configured as described above are described.

First, the user operates the operating board 6 to start the nail print apparatus 1 and to set a print design, etc.

Next, as shown in FIG. 10, the user inserts any of the finger of the hand among the index finger, the middle finger, the ring finger and the little finger as the print finger U1 and the finger is inserted in a stretched state from the finger guiding section 53 to the print finger receiving section 54 with the nail of the finger facing up. The finger other than the above is inserted in the non-print finger receiving section 55 as the non-print finger U2.

As described above, when the user inserts any of the index finger, the middle finger, the ring finger, and the little finger in the finger guiding section 53 and the print finger receiving section 54, and the user inserts the other finger in the non-print finger receiving section 55, the partition wall 51 is held in between the finger inserted in the print finger guiding section 53 and the other finger. Therefore, the finger inserted in the print finger receiving section 54 is stably fixed.

A projecting section 51*b* is formed on a side of the front end 57 of the partition wall 51 and the shape of the cross section of the partition wall 51 at the projecting section 51*b* in the vertical direction is in a tapered shape from a side of the rear end 58 toward a side of the front end 57. With this, the partition wall 51 is thin at a side of the front end 57 of the projecting section 51*b* and the lower surface of the partition wall 51 is an inclined surface 60 inclined toward the lower direction. Therefore, excess strength is not applied to widen the space between the print finger U1 inserted in the print finger receiving section 54 and the non-print finger U2 inserted in the non-print finger receiving section 55. Therefore, the user can insert the fingers in the print finger receiving section 54 and the non-print finger receiving section 55 in a relaxed state, and printing on the nail of the print finger U1 can be performed in a natural state of the finger.

In the present embodiment, even when the finger inserted in the non-print finger receiving section 55 is in a stretched state, a depressed surface 61 of the depressed section 51*c* is formed on the rear side of the projecting section 51*b* of the lower surface of the partition wall 51. With this, the lower surface of the partition wall 51 is depressed to a side of the upper surface 56 in the depressed surface 61. Therefore, the nail of the finger inserted in the non-print finger receiving section 55 does not strike the partition wall 51.

Therefore, even when the finger including a nail on which printing is performed shortly before is inserted in the non-print finger receiving section 55 as the non-print finger U2 and the ink printed on the nail is not completely dry, the design printed on the nail is not damaged or does not peel off by the ink coming into contact with the lower surface of the partition wall 51. Therefore, printing on another fingernail can be performed without waiting for the ink of the nail printed previously to dry, and with this, the time of operation can be shortened.

Then, the nail of the print finger U1 inserted in the print finger receiving section 54 is imaged by the electronic camera 31 in a state illuminated by the illuminating lights 32. With this, the computer of the nail print apparatus 1 recognizes the position, size, range, etc. of the portion of the nail of the finger.

Next, the printing section 20 prints on the nail of the print finger U1 inserted in the print finger receiving section 54.

After printing ends, the user pulls out the print finger U1 from the print finger receiving section 54 and the non-print finger U2 from the non-print finger receiving section 55.

Next, the user inserts any of the finger on which printing is not yet performed among the index finger, the middle finger, the ring finger and the little finger as the print finger U1 and the finger is inserted in the finger guiding section 53 and the print finger receiving section 54 with the nail of the finger facing up. The finger other than the above is inserted in the non-print finger receiving section 55. The printing section 20 similarly prints on the nail of the print finger U1.

Even if the finger of the nail on which printing is already performed is stretched in the non-print finger receiving section 55, the nail of the finger does not come into contact with the partition wall 51. This is because the depressed section 51*c* is formed on the lower surface of the partition wall 51 and the portion on the lower surface of the partition wall 51 corresponding to the nail of the finger inserted in the non-print finger receiving section 55 is depressed to a side of the upper surface 56.

As described above, printing on the nail of the index finger, the middle finger, the ring finger and the little finger is sequentially performed.

The thumb is inserted in the finger guiding section 53 and the print finger receiving section 54 with the nail of the thumb facing up and the printing section 20 similarly prints on the nail of the thumb.

The nail print apparatus of the second embodiment achieves effects similar to those of the nail print apparatus of the first embodiment, and further achieves the following effects.

(4) The projecting section is formed on the front end of the lower surface of the partition wall and the projecting section includes an inclined surface where the lower surface is inclined to the lower direction. The depressed section is formed on the rear side of the projecting section of the lower surface of the partition wall so that the lower surface of the partition wall is depressed in the upper surface direction at the depressed surface of the depressed section. Therefore, when the non-print finger is inserted in the non-print finger receiving section in a stretched state, the nail of the non-print finger does not come into contact with the lower surface of the partition wall. Therefore, even when the finger including a nail on which printing is performed shortly before is inserted in the non-print finger receiving section in a stretched state as the non-print finger and the ink printed on the nail is not completely dry, the design printed on the nail is not damaged or does not peel off by the printed nail coming into contact with the lower surface of the partition wall. Therefore, printing on another fingernail can be performed without waiting for the ink of the nail printed previously to dry, and with this, the time of operation can be shortened.

In the above described embodiment, the nail of the finger of the hand is the print target surface and the above embodiment describes inserting the finger of the hand in the print finger receiving section 54 and the non-print finger receiving section 55. However, the present invention is not limited to the above embodiment. For example, the nail of a toe of a foot can be the print target surface and the toe of the foot can be inserted in the print finger receiving section 54 and the non-print finger receiving section 55. In this case, effects similar to those described above can be achieved.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A nail print apparatus which prints on a nail comprising:

a partition wall which includes a first surface, a second surface opposite to the first surface, a first end and a second end opposite to the first end, wherein the first surface is adapted to contact with at least one first finger insertable in a direction from a side of the first end of the partition wall toward a side of the second end of the partition wall;

wherein the second surface is adapted to contact with at least one second finger which is different from the first finger and which is insertable in the direction from the side of the first end of the partition wall toward the side of the second end of the partition wall; and wherein the partition wall is adapted to be held between the first finger and the second finger from the side of the first end; and a printing section which includes a printing head that is adapted to apply ink to a nail of the first finger, wherein the second surface of the partition wall includes a projecting section which includes an inclined surface inclined in a direction so that a thickness of the partition wall increases from the first end toward the second end, and a depressed section with a flat surface provided between the projecting section and the second end so that the thickness of the partition wall at the depressed section is smaller than a maximum value of the thickness of the partition wall in the projecting portion;

wherein the partition wall is shaped so that when the first finger and the second finger are any of a plurality of fingers of one hand or one foot other than a thumb, the second finger is positionable in a direction along the second surface along a surface direction of the inclined surface so that a surface of the second finger with a nail faces the second surface while the first finger is positioned on the first surface; and wherein the inclined surface of the partition wall is shaped so that when the second finger is positioned along the second surface along the surface direction of the inclined surface, an extending direction of the second finger is a direction in which a distance between the surface with the nail of the second finger facing the inclined surface and the flat surface increases toward the second edge, so as to prevent the nail of the second finger from coming into contact with the second surface.

2. The nail print apparatus according to claim 1, wherein the flat surface of the depressed section has an even thickness between a depressed surface and the second end.

3. The nail print apparatus according to claim 1, wherein a depressed surface of the second surface of the partition wall is provided in a position which is adapted to face the nail of the second finger when the second finger is stretched and inserted along the second surface of the partition wall.

4. The nail print apparatus according to claim 1, further comprising:

a first finger receiving section which is formed on the side of the first surface of the partition wall and which is adapted to receive the first finger; and a second finger receiving section which is formed on the side of the second surface of the partition wall and which is adapted to receive the second finger.

5. The nail print apparatus according to claim 4, wherein:

the first finger receiving section includes a space which is adapted to house the first finger and the first finger receiving section is formed in a shape of a cube with a face on the side of the first end of the partition wall opened; and the first finger receiving section includes a window section which is formed by an opening and which is adapted to expose the nail of the inserted first finger through the window section.

6. The nail print apparatus according to claim 5, further comprising a photographing section which is provided on an upper portion of the window section of the first finger receiving section and which is adapted to photograph the nail of the first finger exposed from the window section.

7. The nail print apparatus according to claim 5, wherein an inner surface on a far side of the first finger receiving section which is adapted to face a tip side of the inserted first finger has a curved shape.

8. The nail print apparatus according to claim 5, wherein the first finger receiving section is adapted to house a plurality of the first fingers simultaneously.

9. The nail print apparatus according to claim 4, further comprising:

a planar front wall section which is connected to the first end of the partition wall and which stands straight from the first surface; and a finger guiding section provided between the front wall section and the first finger receiving section, wherein the first finger receiving section is provided in a position displaced from the first end of the partition wall toward the side of the second end; and wherein the finger guiding section is formed to be depressed from a surface of the front wall section toward the first finger receiving section in a finger inserting direction and wherein a width of the finger guiding section in a direction orthogonal to the finger inserting direction and in a direction along the first surface of the partition wall becomes gradually smaller in the finger inserting direction.

10. The nail print apparatus according to claim 4, further comprising a storing section which is provided in a region on the first surface of the partition wall other than a region on which the first finger receiving section is formed and which stores a print maintenance section that performs maintenance of the printing section.

11. The nail print apparatus according to claim 10, wherein the print maintenance section includes at least one of a head cleaning/cap mechanism and an ink disposing section, wherein the head cleaning/cap mechanism includes a function which performs cleaning of the printing head and a function which covers the printing head with a cap when the printing head is not used to maintain a moisture state of the printing head and wherein the ink disposing section receives excess ink ejected from the printing head.

* * * * *